US005926682A

United States Patent [19]

Tomiki

[11] Patent Number: 5,926,682

[45] Date of Patent: Jul. 20, 1999

[54] IMAGE FORMING APPARATUS

[75] Inventor: Satoshi Tomiki, Tokyo, Japan

[73] Assignee: Canon Kabushiki Kaisha, Tokyo, Japan

[21] Appl. No.: 09/018,299

[22] Filed: Feb. 4, 1998

[30] Foreign Application Priority Data

Feb. 7, 1997 [JP] Japan ..... 9-039987

[51] Int. Cl.[6] ..... G03G 15/16

[52] U.S. Cl. ..... 399/388; 399/381

[58] Field of Search ..... 399/388, 381, 399/316, 297, 66, 107, 121

[56] References Cited

U.S. PATENT DOCUMENTS

| | | | |
|---|---|---|---|
| 4,101,212 | 7/1978 | Sumiyoshi et al. | 399/388 |
| 5,453,823 | 9/1995 | Hashizume et al. | 399/318 |
| 5,504,565 | 4/1996 | Tomiki et al. . | |

FOREIGN PATENT DOCUMENTS

| | | |
|---|---|---|
| 3-158877 | 7/1991 | Japan . |
| 3-186878 | 8/1991 | Japan . |
| 3-192285 | 8/1991 | Japan . |
| 4-352183 | 12/1992 | Japan . |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus has an image bearing member, a transfer device for transferring a toner image from the image bearing member to a transfer material at a transfer station and a guide member for guiding the transfer material to the transfer station. The guide member has a notch formed at a most downstream side and, on account of the notch, a final guide point, effected by the guide member, of a transfer material having a small width in a direction perpendicular to the transfer material moving direction is positioned at an upstream side of that of a transfer material having a wide width.

13 Claims, 3 Drawing Sheets

IMAGE FORMING APPARATUS

BACKGROUND OF THE INVENTION

1. Field of the Invention

The present invention relates to an image forming apparatus such as an electrostatic copying machine, an electrostatic printer and the like, in which a toner image is transferred from an image bearing member onto a transfer material.

2. Related Background Art

There have widely been used image forming apparatuses for transferring a transferable toner image formed on an image bearing member onto a transfer material.

FIG. 6 is a schematic constructural view showing a typical example of such an image forming apparatus. Briefly explaining construction and function of the image forming apparatus, a surface of an image bearing member (referred to as "photosensitive member" hereinafter) 10 rotated in a direction shown by the arrow X is uniformly charged by a first charger 11, and, by applying image exposure 12 (such as a laser beam which is image-modulated) to the charged surface of the photosensitive member, potential of the exposed surface is reduced, thereby forming an electrostatic latent image.

Then, when the latent image reaches a developing station where the photosensitive member 10 is opposed to a developing device 13, toner is supplied to the latent image from the developing device 13, thereby forming a toner image. During further rotation of the photosensitive member 10, when the toner image reaches a transfer station where the photosensitive member 10 is opposed to a transfer charger 16, in synchronous with this, a transfer material 18 conveyed and guided by a transfer guide member (referred to as "transfer inlet guide" hereinafter) 114 comprised of an upper transfer material guiding member (referred to as "transfer inlet upper guide") 114*a* and a lower transfer material guiding member (referred to as "transfer inlet lower guide") 114*b* is supplied to the transfer station to be contacted with the photosensitive member 10, and the toner image on the photosensitive member 10 is transferred onto the transfer material 18 by the action of a transfer electric field generated by the transfer charger 16.

Thereafter, the transfer material 18 is separated from the photosensitive member 10 and then is conveyed to a fixing station (not shown), where the toner image is fixed to the transfer material. Then, the transfer material is discharged out of the image forming apparatus. On the other hand, residual toner remaining on the photosensitive member 10 is removed by a cleaner 17 for preparation for next image formation.

The transfer inlet guide 114 is sometimes formed from insulation material, so that poor transferring such as transfer void (generated by leaking transfer current to the transfer inlet guide 114 through the transfer material which absorbed moisture to reduce the resistance thereof under high humidity environment) can be prevented.

Recently, a transfer charger of contact type such as a transfer roller has widely been used as the transfer charger. In comparison with a corona charger, the transfer charger of contact type has advantages that capacity of a power source can be reduced and that discharge products such as ozone can be suppressed.

As an image forming method, normal development in which only a portion of the charged surface of the photosensitive member corresponding to a background portion of the image information is exposed (background exposure system) and portions other than the background portion is developed, or inversion-development in which only a portion of the charged surface of the photosensitive member corresponding to an image information portion is exposed (image exposure system) and non-exposed portion is developed can be used.

However, in the arrangement as shown in FIG. 6, the transfer inlet guide 114 is expected to positively direct the transfer material 18 to a predetermined position on the photosensitive member 10. Thus, a tip end (near the photosensitive member) of the transfer inlet guide 114 is normally disposed in the vicinity of the surface of the photosensitive member 10 with a small gap of about 1 to 3 mm, and, since the transfer inlet guide 114 is disposed relatively near the transfer charger 16, the transfer inlet guide is apt to be charged with polarity same as the transfer current, i.e., polarity opposite to that of the toner.

Accordingly, the toner floating within the apparatus and/or the toner on the surface of the photosensitive member 10 at the transfer station is electrostatically absorbed to the transfer inlet guide (particularly, the transfer inlet upper guide 114*a* positioned at an upstream side in a photosensitive member moving direction) to contaminate the guide. In particular, a relatively large amount of toner is adhered to the tip end of the guide, with the result that the toner is adhered to the transfer material to deteriorate image quality.

Particularly, in the inversion-development in which the toner image is formed on the surface of the photosensitive member having the same polarity as that of the toner, since an adhering force of the toner to the surface of the photosensitive member is small in comparison with the normal development, the toner is more apt to be absorbed to the transfer inlet upper guide 114*a* electrostatically.

To avoid this, if the transfer inlet upper guide 114*a* is spaced apart from the surface of the photosensitive member, a curled transfer material cannot be conveyed to the transfer station positively, thereby causing poor conveyance (sheet jam).

In addition to the above-mentioned inconveniences, when a special transfer material is used, the following disadvantage occurs.

That is to say, when a transfer material having relatively great resiliency such as a post card and an envelope is used, after the transfer material is passed through a pair of regist rollers 15, the trail end of the transfer material is sprung up to contact with or strike against the transfer inlet guide 114, with the result that the toner adhered to the transfer inlet upper guide 114*a* is scattered by the shock, thereby contaminating an imaged surface of the transfer material.

Particularly, in the inversion-development, since the adhering force of the toner to the surface of the photosensitive member is small in comparison with the normal development, the toner is influenced by a small electrostatic force, so that not only the toner is easily adhered to the transfer inlet upper guide 115*a* but also the image is apt to be subjected to an image scattering phenomenon such as smeared image trailing edge. It is considered that the image scattering phenomenon is generated by distorting the toner image by a weak transfer electric field existed immediately in front of the transfer station (referred to as "pre-transfer" hereinafter).

In order to prevent the image scattering phenomenon, the transfer inlet guide 114 may be disposed at a relatively upstream side of the surface of the photosensitive member so that the transfer material is contacted with the surface of the photosensitive member at a position sufficiently spaced apart from the transfer station, i.e., in front of a pre-transfer area. However, in such an arrangement, an amount of spring-up of the trail end of the transfer material having relatively great resiliency is further increased.

SUMMARY OF THE INVENTION

An object of the present invention is to provide an image forming apparatus in which toner contamination of a transfer material due to toner contamination of a transfer material guiding member can be prevented.

Another object of the present invention is to provide an image forming apparatus in which toner contamination of a thick transfer material such as a post card due to toner contamination of a transfer material guiding member can be prevented.

A further object of the present invention is to provide an image forming apparatus in which a transfer material can effectively be guided to a transfer station regardless of the kind of the transfer material.

A still further object of the present invention is to provide an image forming apparatus in which a transfer material can effectively be guided to a transfer station even when a normal sheet is used as the transfer material.

The other objects and features of the present invention will be apparent from the following detailed explanation of the invention referring to the accompanying drawings.

DETAILED DESCRIPTION OF THE PREFERRED EMBODIMENTS

Figure 1:
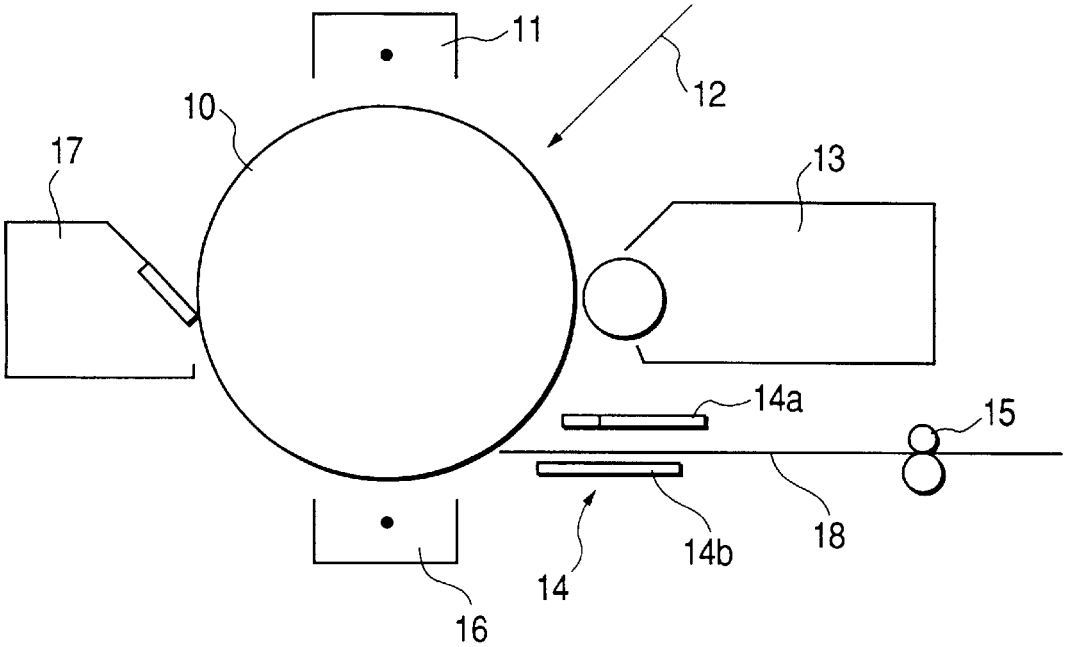
FIG. 1 is a schematic constructural view of an image forming apparatus according to a first embodiment of the present invention.
Figure 6:
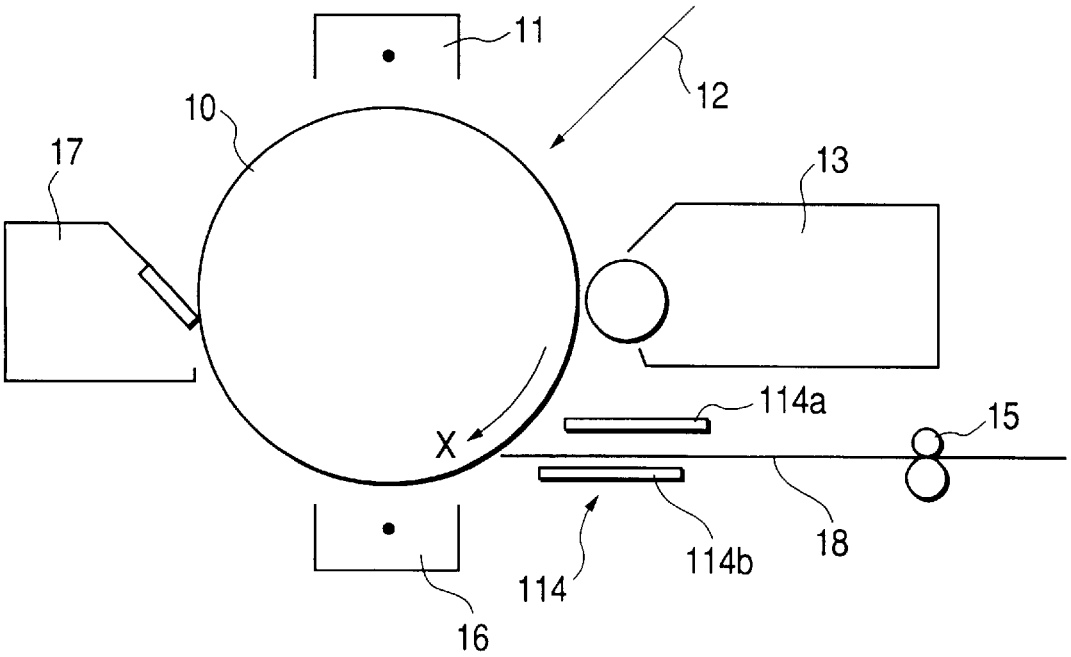
FIG. 6 is a schematic constructural view showing a conventional image forming apparatus.

The present invention will now be explained in connection with embodiments thereof with reference to the accompanying drawings. Incidentally, in the explanation of the following embodiments of the present invention, the present invention can be embodied as an image forming apparatus same as shown in FIG. 1, except for a transfer material guiding member (and an image forming apparatus shown in FIG. 6), and, accordingly explanation of the entire construction and function of the image forming apparatus will be omitted and features of the present invention will be explained. Further, the same elements as those shown in FIG. 6 are designated by the same reference numerals.

<First Embodiment>

First of all, a first embodiment of the present invention will be described with reference to FIGS. 1 and 2.

In an image forming apparatus shown in FIG. 1, it is assumed that charging polarity of a photosensitive member (image bearing member) 10 is negative, charging polarity of toner of a toner image on the photosensitive member 10 is negative and polarity of transfer bias of a transfer charger 16 is positive. That is to say, in the first embodiment, inversion-development is used.

In the illustrated embodiment, a transfer inlet guide (transfer material guiding member) 14 has a transfer inlet upper guide (upper transfer material guiding member) 14*a* and a transfer inlet lower guide (lower transfer material guiding member) 14*b* and is formed from insulation material. Incidentally, in the illustrated embodiment, a minimum distance between a surface of the photosensitive member and the transfer inlet upper guide is set to 2.0 mm. Further, in the illustrated embodiment, the transfer inlet upper and lower guides 14*a*, 14*b* are secured to predetermined positions by a support means (not shown) so that a relative positional relation between these guides is unchanged. A transfer material 18 is guided to a predetermined position while being passed between the transfer inlet upper and lower guides 14*a* and 14*b*. The transfer inlet upper and lower guides 14*a*, 14*b* are disposed so that a tip end of the transfer material is guided to a position slightly at an upstream side of a transfer station in a photosensitive member moving direction. With this arrangement, pre-transfer due to a transfer electric field of a transfer charger can be prevented. However, in this case, particularly when a thick sheet is used as the transfer material, after the transfer material is passed through a pair of regist rollers, a trail end of the transfer material is sprung up, thereby generating vibration.

Figure 2:
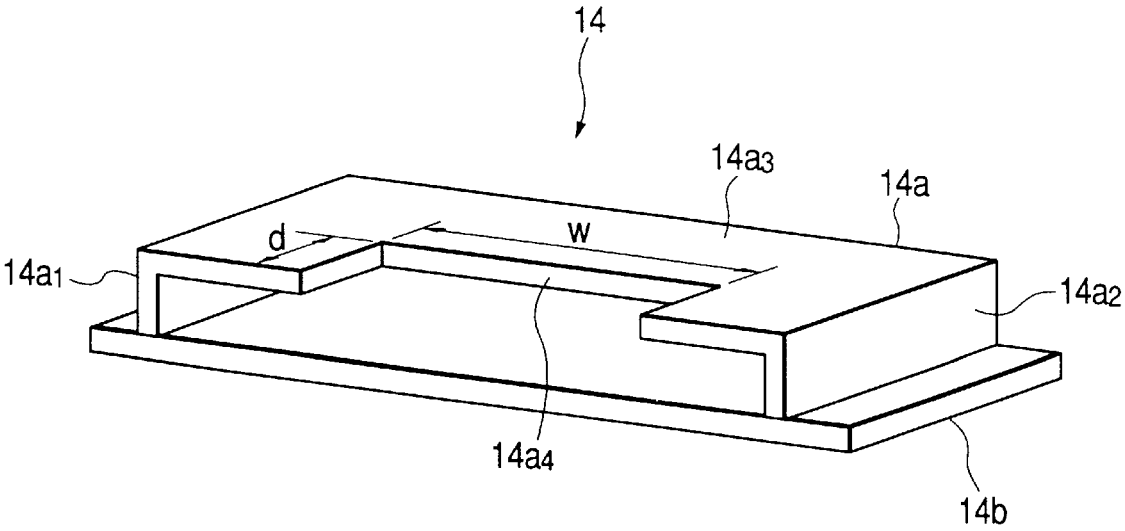
FIG. 2 is a perspective view of a transfer material guiding member according to the first embodiment.

FIG. 2 shows the transfer inlet guide 14 according to the first embodiment looked at from the above obliquely. In the illustrated embodiment, the transfer inlet guide 14 is formed from insulation material such as ABS (acrylonitrile-butadiene-styrene) resin.

The transfer inlet guide 14 includes the flat plate-shaped transfer inlet lower guide 14*b*, and the transfer inlet upper guide 14*a* comprised of two upright portions 14*a*1, 14*a*2 extending upwardly from the transfer inlet lower guide 14*b* with a predetermined distance therebetween and a guide portion 14*a*3 extending between the upright portions 14*a*1 and 14*a*2 in parallel with the transfer inlet lower guide 14*b*. A rectangular notch 14*a*4 is formed in a central portion of the guide portion 14*a*3 opposed to the photosensitive member 10. In the illustrated embodiment, a width W of the notch 14*a*4 of the transfer inlet upper guide 14*a* is selected to 160 mm slightly greater than a width of a return post card (about 150 mm at a shorter side). Further, a depth d of the notch 14*a*4 is selected to 5 mm. Incidentally, the return post card is conveyed in such a manner that a longitudinal direction of the transfer material coincides with a transfer material conveying direction, and a normal post card is conveyed in such a manner that a longitudinal direction of the transfer material becomes perpendicular to the transfer material conveying direction.

With this arrangement, since the toner is not adhered to the central notch 14*a*4, even when the transfer material having relatively great resiliency such as a post card or an envelope (thick sheet having a thickness greater than that of a normal sheet) is used, so long as the width of the transfer material is smaller than 160 mm, since the transfer material passes through the notch 14*a*4, toner contamination of the transfer material can be suppressed or prevented. Incidentally, since the transfer material having the greatest frequency of use is a normal post card, it is desirable that the width W of the notch is selected to become greater than a longitudinal dimension (148 mm) of the normal post card.

Further, since the depth d of the notch 14*a*4 is selected to 5 mm in consideration of poor conveyance of not only the normal sheet having A3 size or A4 lateral size but also the normal sheet having smaller width, the poor conveyance can be prevented. Among the normal sheets, the sheets having high frequency of use are A4 size sheet, Letter size sheet and Legal size sheet, and, it is preferable that the width W of the notch is smaller than shorter sides of these rectangular sheets. The reason is that, when the normal sheet having A4 size, Letter size or Legal size is guided by the transfer inlet upper guide, if the width of the notch is greater than the width of such a normal sheet, the normal sheet is not guided at a most downstream side of the transfer inlet upper guide, but, if the width of the notch is smaller than the width of such a normal sheet, the normal sheet can be guided by an outer portion of the notch at the most downstream side of the transfer inlet upper guide. The selection of the width of the notch as mentioned above is preferable to effectively guide the normal sheet thicker than the post card to the transfer station. It is further preferable that the width W of the notch is selected to become smaller than a shorter side of B5 size sheet.

Further, since the transfer inlet guide 14 is made of insulation material, the transfer material 18 is in an electrically floating condition. Thus, even if the transfer material absorbs moisture to reduce resistance thereof, the transfer current is prevented from leaking through the transfer inlet guide 14, thereby preventing the transfer void.

In order to solve the problem that the toner is adhered to the guide, for example, the transfer inlet guide 14 may be formed from conductive material and bias voltage having polarity opposite to that of the transfer current (i.e., polarity same as that of the toner) may be applied to the transfer inlet guide.

However, in such an arrangement, since there is the tendency to promote the leakage of the transfer current, if the transfer material absorbs moisture to reduce resistance thereof, the transfer current becomes insufficient to increase the occurrence of the transfer void, and, thus, such an arrangement cannot be put to practical use. Particularly when a transfer charger of contact type such as a charge roller is used, due to lack of the transfer current and reduction of the transfer voltage, for example, the resistance of the transfer roller becomes uneven locally, thereby causing spotted transfer void.

Accordingly, as mentioned above, it is preferable that the transfer inlet guide is formed from the insulation material.

By forming the transfer inlet guide as mentioned above, even when the transfer material having relatively great resiliency such a post card or an envelope is used, the toner contamination can be suppressed or prevented and the poor conveyance of the normal sheet can be prevented, and at the same time the transfer void can also be prevented. Incidentally, although the toner dropped from the developing device may be adhered to a portion of the transfer material corresponding to the notch of the transfer inlet upper guide, since an amount of such toner is considerable small in comparison with the conventional case where the toner accumulated on the conventional transfer inlet upper guide is dropped onto the transfer material at once, there is no problem. When the notch is formed in the transfer inlet upper guide, even if the toner is dropped from the developing device, since the toner is adhered to the transfer material little by little, the toner is hard to be accumulated on the transfer inlet lower guide.

Incidentally, in the illustrated embodiment, while an example that the width of the central notch is selected to 160 mm slightly greater than the shorter side of the return post card and the depth of the notch is selected to 5 mm was explained, the present invention is not limited to such an example. Further, the insulation material is not limited to the ARS resin, but, for example, insulation material having good slipping ability such as polyethylene may be used.

<Second Embodiment>

Figure 3:
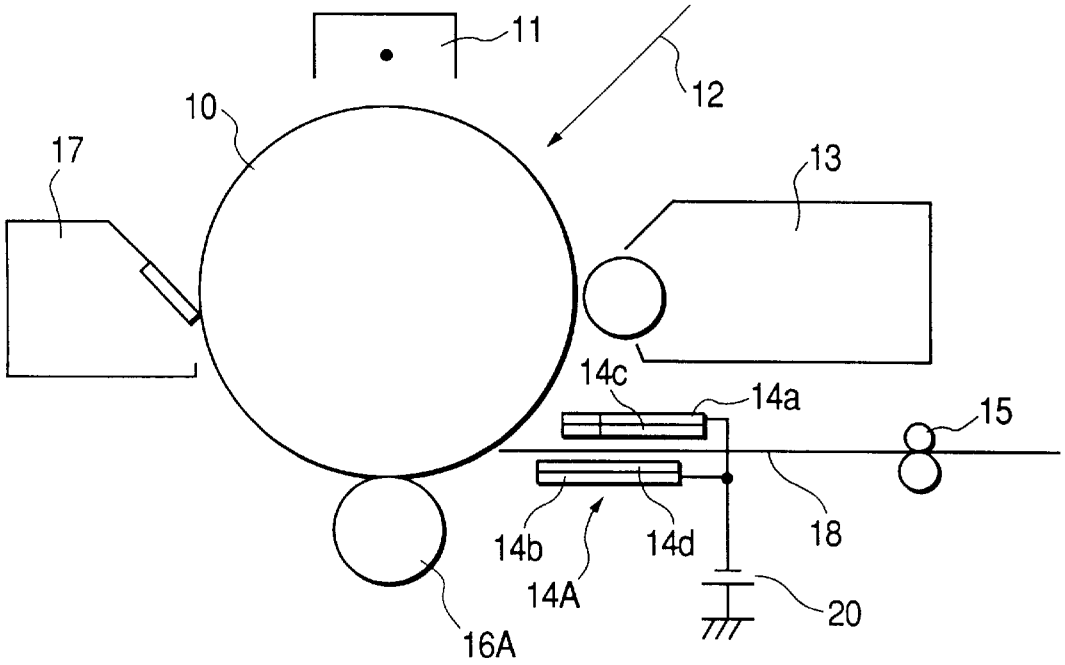
FIG. 3 is a schematic constructural view of an image forming apparatus according to a second embodiment of the present invention.

Next, a second embodiment of the present invention will be explained with reference to FIGS. 3 and 4.

As is in the first embodiment, in an image forming apparatus according to the second embodiment, it is assumed that charging polarity of a photosensitive member is negative, charging polarity of toner of a toner image on the photosensitive member is negative and polarity of transfer bias is positive. That is to say, in the second embodiment, inversion-development is used. Incidentally, in the second embodiment, a transfer roller (transfer charger of contact type) is used as a transfer charger 16A.

Figure 4:
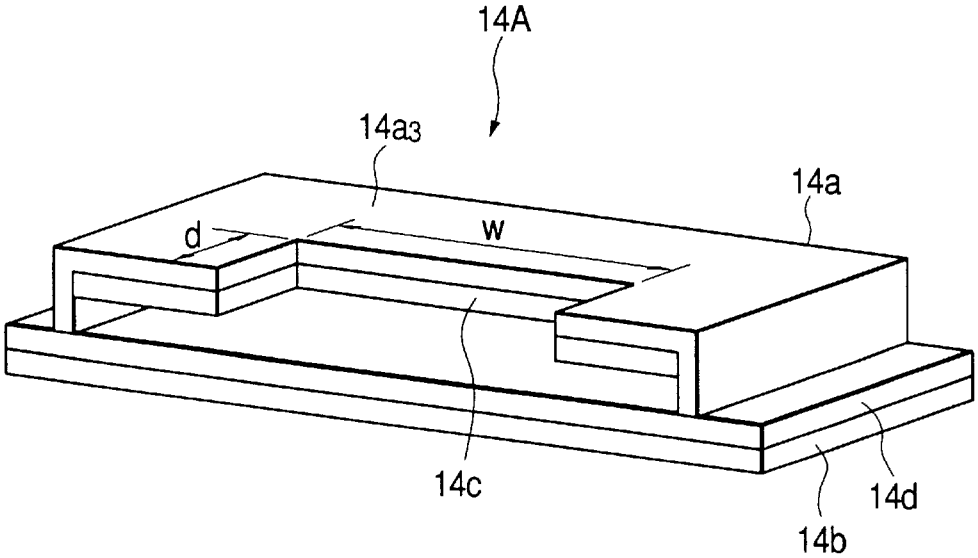
FIG. 4 is a perspective view of a transfer material guiding member according to the second embodiment.

As shown in FIG. 4, a transfer inlet guide 14A according to the second embodiment includes transfer inlet upper and lower guides 14*a*, 14*b* having the same configurations as those in the first embodiment and formed from conductive material, and an insulation member 14*d* is secured to an upper surface of the transfer inlet lower guide 14*b* and an insulation member 14*c* is secured to a lower surface of a guide portion 14*a*3 of the transfer inlet upper guide so that the transfer inlet upper and lower guides 14*a*, 14*b*.

A minimum distance between the surface of the photosensitive member and the transfer inlet guide is set to 2.0 mm, and bias having polarity opposite to that of the transfer bias (i.e., polarity same as that of the toner forming the toner image) is applied to the conductive transfer inlet upper and lower guides 14*a*, 14*b* from a power source 20.

In the second embodiment, the transfer inlet upper and lower guides 14*a*, 14*b* are secured to predetermined positions by a support means (not shown) so that a relative positional relation between these guides is unchanged. A transfer material 18 is guided to a predetermined position while being passed between the transfer inlet upper and lower guides 14*a* and 14*b*. The transfer inlet upper and lower guides 14*a*, 14*b* are disposed at the same orientation as the first embodiment so that a tip end of the transfer material is guided to a position slightly at an upstream side of a transfer station in a photosensitive member moving direction.

In the second embodiment, the conductive transfer inlet upper and lower guides 14*a*, 14*b* are formed from sheet metal and the insulation members 14*c*, 14*d* are formed from ABS resin. The insulation members 14*c*, 14*d* are constituted by flat plates secured to the conductive transfer inlet upper and lower guides 14*a*, 14*b*. In the illustrated embodiment, a width W of the notch is selected to 160 mm slightly greater than a width of the return post card, and a depth d of the notch is selected to 3 mm. Of course, the width W of the notch is greater than a longitudinal dimension of the normal post card.

With the arrangement as mentioned above, by the bias applied to the transfer inlet upper and lower guides 14*a*, 14*b*, an amount of the toner in the toner image (advancing toward the transfer station) separated from the photosensitive member and transferred onto the transfer inlet upper guide 14*a* by the electrostatic force at a position near the transfer inlet upper guide 14*a* immediately before the transfer station and an amount of the toner (floating within the apparatus) adhered to the transfer inlet upper guide 14*a* can be reduced, thereby further suppressing or preventing the toner contamination of the transfer material. Further, in the illustrated embodiment, the depth d of the notch can be selected to 3 mm. Also in this case, the poor conveyance can be prevented completely.

Since the inner sides of the transfer inlet upper and lower guides 14*a*, 14*b* are constituted by the insulation members 14*c*, 14*d*, the transfer material 18 in an electrically floating condition. Thus, even if the transfer material absorbs moisture to reduce resistance thereof, the transfer current is prevented from leaking through the transfer inlet upper and lower guides 14*a*, 14*b*, thereby preventing the transfer void.

By constructing the transfer inlet guide as mentioned above, the toner contamination of the transfer material can be suppressed or prevented and the transfer void (particularly, spotted transfer void in the transfer roller) can be prevented. In the illustrated embodiment, the insulation material forming the insulation members is not limited to the ABS resin, but, for example, insulation material having good slipping ability such as polyethylene may be used.

<Third Embodiment>

Figure 5:
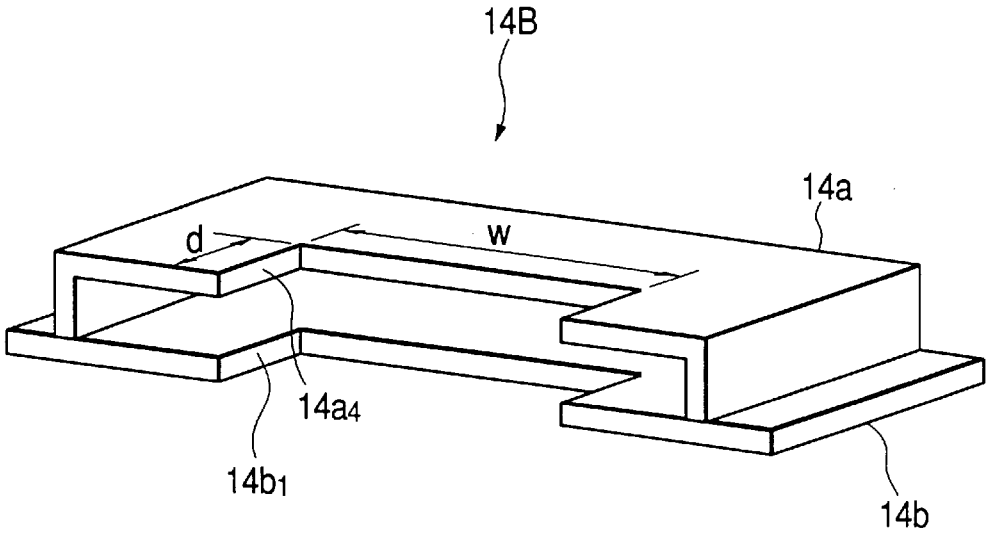
FIG. 5 is a perspective view of a transfer material guiding member according to a third embodiment of the present invention.

Next, a third embodiment of the present invention will be explained with reference to FIG. 5. Although a transfer inlet guide 14B according to the third embodiment has a construction similar to that in the first embodiment, a notch 14*b*1 is formed in a transfer inlet lower guide 14*b* in correspondence to the notch 14*a*4 of the transfer inlet upper guide 14*a*.

In the third embodiment, as is in the second embodiment, widths W of the notches 14*a*4, 14*b*1 of the transfer inlet upper and lower guides 14*a*, 14*b* are selected to 160 mm slightly greater than a width of the return post card, and depth d of the notches 14*a*4, 14*b*1 are selected to 3 mm.

By forming the transfer inlet guide as mentioned above, even when the transfer material having relatively great resiliency such as a post card or an envelope is used, the toner contamination can be suppressed or prevented and the poor conveyance of the normal sheet can be prevented, and at the same time the transfer void can also be prevented. Particularly, the transfer void regarding a small size thick sheet such as a post card can effectively be prevented.

In the first to third embodiments, since a conveyance reference position of the transfer material in a direction perpendicular to the transfer material conveying direction is a central position, the central position of the transfer material is not substantially changed regardless of the size of the transfer material. Further, since the normal sheet is apt to be curled at both ends thereof in the direction perpendicular to the transfer material conveying direction, it is preferable that any notches are not formed in portions of the transfer inlet guide corresponding to both ends of the transfer material to positively guide the both ends of the transfer material by the transfer inlet guide.

By providing the notch in the transfer inlet lower guide in correspondence to the notch of the transfer inlet upper guide, the transfer void regarding a small size thick sheet such as a post card can effectively be prevented.

Lastly, when the transfer means cooperating with the photosensitive member to form a nip therebetween is used, the spotted transfer void can also be prevented.

What is claimed is:

1. An image forming apparatus comprising:

an image bearing member for bearing a toner image;

a transfer means for transferring the toner image from said image bearing member to a transfer material at a transfer station; and a guide member for guiding a surface on said image bearing member side of the transfer material to the transfer station, said guide member including a notch formed at a most downstream side thereof in a transfer material moving direction;

wherein, on account of the notch, a final guide point, effected by said guide member, of a transfer material having a small width in a direction perpendicular to the transfer material moving direction is positioned at an upstream side of that of a transfer material having a wide width.

2. An image forming apparatus according to claim 1, wherein a length of said notch in a direction perpendicular to the transfer material moving direction is larger than a width of a thick sheet in the direction perpendicular to the transfer material moving direction, said thick sheet being thicker than a normal sheet used as the transfer material.

3. An image forming apparatus according to claim 1, wherein a length of said notch in a direction perpendicular to the transfer material moving direction is larger than a width of a normal post card used as the transfer material in the direction perpendicular to the transfer material moving direction.

4. An image forming apparatus according to claim 1, 2 or 3, wherein a length of said notch in a direction perpendicular to the transfer material moving direction is smaller than a shorter side of an A4 size sheet used as the transfer material.

5. An image forming apparatus according to claim 1, 2 or 3, wherein a length of said notch in a direction perpendicular to the transfer material moving direction is smaller than a shorter side of a Letter size sheet used as the transfer material.

6. An image forming apparatus according to claim 1, wherein said notch is formed in said guide member except for both ends thereof in a direction perpendicular to the transfer material moving direction.

7. An image forming apparatus according to claim 6, wherein the transfer material is conveyed in such a manner that a central position of the transfer material is not substantially changed regardless of a size of the transfer material.

8. An image forming apparatus according to claim 1, further comprising an image forming means for forming the toner image, and wherein said image forming means includes a latent image forming means for forming a latent image on said image bearing member, and a developing means for inversion-developing the latent image with toner.

9. An image forming apparatus according to claim 1, wherein said guide member includes a conductive member to which voltage having the same polarity as charging polarity of the toner image is applied.

10. An image forming apparatus according to claim 9, wherein said guide member includes an insulation member supported by said conductive member and disposed in an area, where said insulation member can be contacted with the transfer material.

11. An image forming apparatus according to claim 1, wherein said guide member is an insulation member.

12. An image forming apparatus according to claim 1, further comprising a second guide member for guiding a surface on said transfer means side of the transfer material, said second guide member being provided with a notch corresponding to the notch of said guide member.

13. An image forming apparatus according to claim 1, wherein said transfer means includes a transfer member for cooperating with said image bearing member to form a nip therebetween.

* * * * *

UNITED STATES PATENT AND TRADEMARK OFFICE

CERTIFICATE OF CORRECTION

PATENT NO. : 5,926,682

DATED : July 20, 1999

INVENTOR(S): SATOSHI TOMIKI

It is certified that error appears in the above-identified patent and that said Letters Patent is hereby corrected as shown below:

COVER PAGE AT ITEM [54] TITLE:
"IMAGE FORMING APPARATUS" should read -AN IMAGE FORMING APPARATUS FOR CONVEYING A TRANSFER MATERIAL TO A TRANSFER STATION BY A TRANSFER GUIDE HAVING A NOTCH IN A TIP END THEREOF-.

COLUMN 1:
Line 33, "synchronous" should read -synchronism-.

COLUMN 2:
Line 2, "is" should read -are-; and
Line 61, "existed" should read -existing-.

COLUMN 5:
Line 4, "Letter" should read -letter-;
Line 5, "Legal" should read -legal-;
Line 8, "Letter size or Legal" should read -letter size or legal-; and
Line 55, "considerable" should read -considerably-.

UNITED STATES PATENT AND TRADEMARK OFFICE

CERTIFICATE OF CORRECTION

PATENT NO. : 5,926,682

DATED : July 20, 1999

INVENTOR(S): SATOSHI TOMIKI

It is certified that error appears in the above-identified patent and that said Letters Patent is hereby corrected as shown below:

COLUMN 8:

Line 27, "Letter" should read -letter-.

Signed and Sealed this

Twenty-ninth Day of February, 2000

*Attest:*

Q. TODD DICKINSON

*Attesting Officer*

*Commissioner of Patents and Trademarks*